United States Patent [19]

Conover

[11] Patent Number: 4,609,175

[45] Date of Patent: Sep. 2, 1986

[54] LEG-SUPPORTED UMBRELLA HOLDER

[76] Inventor: Lynn Conover, 1028 Manzanita Dr., Phoenix, Ariz. 85020

[21] Appl. No.: 631,149

[22] Filed: Jul. 16, 1984

[51] Int. Cl.[4] ..... A47G 25/12

[52] U.S. Cl. ..... 248/519; 135/16; 211/62

[58] Field of Search ..... 211/62, 63; 248/519, 248/444; 280/289 WC; 135/16, 37, 48, 33 R, 33 C

[56] References Cited

U.S. PATENT DOCUMENTS

| | | | |
|---|---|---|---|
| 933,142 | 9/1909 | Vogt | 211/62 |
| 1,336,321 | 4/1920 | Stahl | 211/62 X |
| 1,392,120 | 9/1921 | Cooper | 211/62 |
| 2,627,217 | 2/1953 | Hainke et al. | 135/16 X |
| 3,582,028 | 6/1971 | Purdy | 248/519 X |
| 4,088,294 | 5/1978 | Aliment et al. | 248/519 |

FOREIGN PATENT DOCUMENTS

| | | | |
|---|---|---|---|
| 502985 | 7/1930 | Fed. Rep. of Germany | 211/62 |
| 2036123 | 6/1980 | United Kingdom | 135/16 |

*Primary Examiner*—Robert A. Hafer
*Assistant Examiner*—Arnold W. Kramer
*Attorney, Agent, or Firm*—James F. Duffy; Robert A. Hirschfeld

[57] ABSTRACT

A leg-supported umbrella holder is grasped between the thighs of a wheelchair-bound person while supported by the seat of a wheelchair. An umbrella shaft and handle are clamped within the holder in upright position, permitting use of both hands for locomotion, and convenient, rapid umbrella disposition in avoiding obstacles and negotiating doorways. A variety of umbrella handle configurations are accommodated, rotation of the umbrella is inhibited, and provision is made for freestanding upright support of the umbrella upon a horizontal surface such as a floor conveniently accessible when the holder is not deployed upon the wheelchair.

9 Claims, 6 Drawing Figures

LEG-SUPPORTED UMBRELLA HOLDER

DESCRIPTION

1. Technical Field

The invention relates generally to umbrella holders and more specifically to umbrella holders for use by chair-bound persons.

2. Background Art

Persons in wheelchairs often use their hands to provide or assist with locomotion and guidance of the chair in which they sit. Outdoors, chair-bound persons may require umbrella protection from inclement weather or excessive sunlight. The holding of a conventional umbrella by the hands of chair-bound persons impedes use of said hands for locomotion and guidance.

In the past, prior art has included means for attaching or supporting an umbrella to the body or to the wheelchair by clamps, harnesses and the like. Fixed mounting of an umbrella to the body or wheelchair impedes rapid umbrella deployment or disengagement not only in the event of sudden downpour, but also in traversing doorways between indoors and outdoors, and in displacing the umbrella so as to avoid interfering obstacles. Fixation of the umbrella's handle or shaft to an outer periphery of a wheelchair displaces the center of the typically round protective area from the center of a seated person, unnecessarily offsetting the locus of protection, and causing the region of potential interference by the open umbrella periphery with obstacles or obstructions to be offset in the direction of the wheelchair's front, rear or side.

Indoors, the chair-bound person, whose manual grasping radius is limited, may wish to conveniently dry a wet umbrella, or to store the umbrella and its holder stably and readily graspable from the wheelchair.

A need exists for an umbrella holder which neither requires continuous hand-grasping nor fixation to the body or wheelchair, which permits rapid deployment or disengagement, which is centered in use over the center of a seated chair-bound person, which is adaptable to a wide variety of umbrella handle and shaft configurations, and which permits free-standing storage or drying of the umbrella in a position readily graspable by a wheelchair-bound person.

It is an object of this invention to provide an improved umbrella holder.

It is a further object of this invention to provide an umbrella holder for use by chair-bound persons which does not require attachment to the chair, the person or to his clothing.

Another object of this invention is that the holder be locatable so as to approximately center the opened umbrella over the center of the seated person.

An additional object of this invention is that a variety of umbrella handle and shaft configurations be clampable to the umbrella holder.

A further object of this invention is to clamp an umbrella shaft or handle so as to inhibit rotation thereof.

It is also an object of this invention to provide a holder which when placed on a generally horizontal surface is capable of upright freestanding support of the umbrella, within easy grasping distance of a chair-bound person.

An object of an alternative embodiment of this invention is that clamping means be adapted to mate with an umbrella handle of selected configuration.

DISCLOSURE OF INVENTION

In accordance with one embodiment of this invention, an umbrella holder comprises a base graspable by the thighs of a seated person and coupled to the handle or shaft of an umbrella. The base has a bottom surface which rests on the chair surface beneath a chair-bound person in use, or stably upon a generally horizontal surface such as floor, tabletop or ground when not in use, and includes a cavity or recess accommodating a variety of sizes and shapes of umbrella handles. Clamping means, such as a hinged clamp, secured by hooks or hook-and-loop fasteners such as marketed under the trademark VELCRO, affix the umbrella at its handle or adjacent shaft portion, to the base. Slots, protrusions or other mating or interfering surfaces are provided within the cavity or recess to inhibit rotation of the umbrella handle or shaft therein.

In accordance with another embodiment of this invention, a cavity or recess is adapted to a selected umbrella handle and shaft configuration.

A chair-bound person, with or without assistance, clamps a conventional umbrella's handle and shaft within the holder, and places the base upon the chair seat, between the person's thighs. When encountering obstacles, doorways and the like, the chair-bound person can easily reposition or remove the umbrella and its holder momentarily, and replace them thereafter. The holder and umbrella may be dried or stored upright by the chair-bound person within easy reach.

BEST MODES FOR CARRYING OUT THE INVENTION

Figure 1:
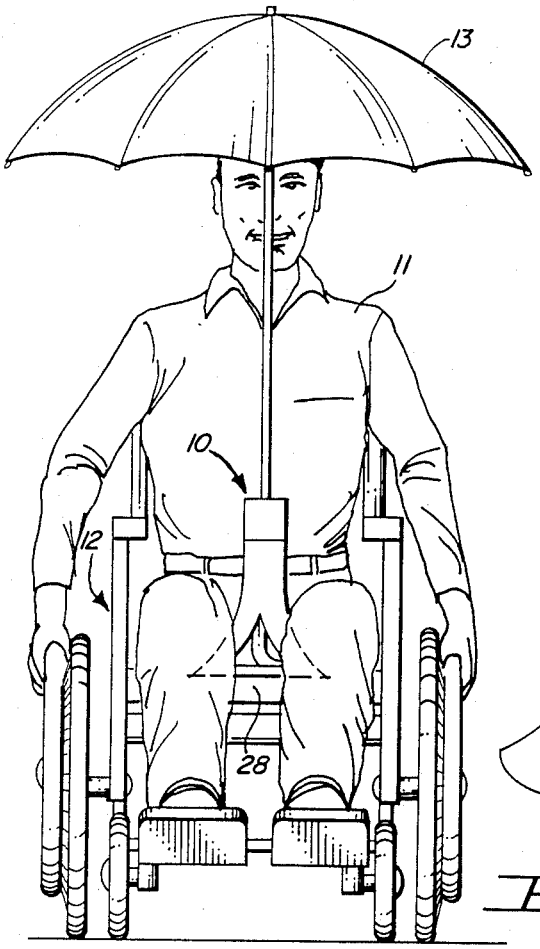
FIG. 1 is a front view of the leg-supported umbrella holder, showing the holder in use upon the seat of a wheelchair, held in upright position by the thighs of the wheelchair-bound person.

For the purpose of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

Referring to FIG. 1, a front view shows a leg-supported umbrella holder generally referred to as reference number 10, attached to an umbrella 13, resting upon a seat 28 of a wheelchair 12, and supported in upright position by the thighs of a wheelchair-bound person 11.

Figure 2:
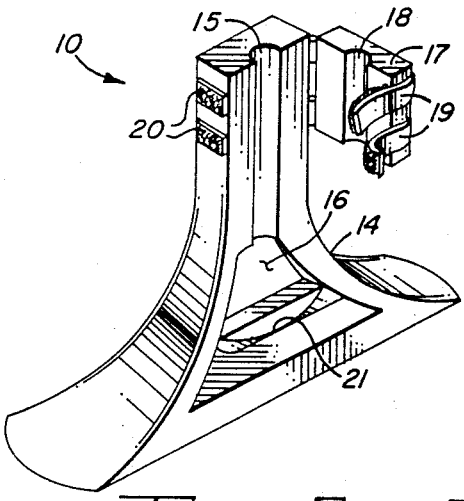
FIG. 2 is a perspective view of the leg-supported umbrella holder showing an opened hinged clamping closure prior to insertion of an umbrella shaft, a void to accommodate various sizes and shapes of umbrella handles, and a rotation-inhibiting groove.
Figure 3:
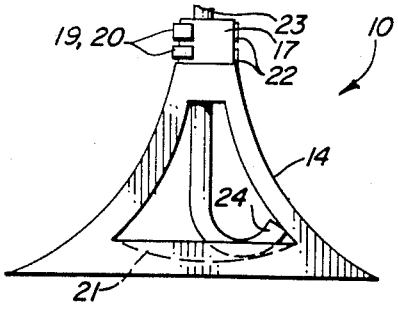
FIG. 3 is a front view of the leg-supported umbrella holder illustrating the holding of an umbrella shaft and handle.

Referring to FIG. 2, a perspective view of the leg-supported umbrella holder 10 of FIG. 1 shows a base 14 suitable for support upon a generally horizontal surface such as a wheelchair seat, the floor, a tabletop, or the like, and for grasping by the thighs of a person seated in a wheelchair when resting upon a wheelchair seat. Groove 15 in base 14 is of a size and orientation suitable for mating with an umbrella shaft 23 (shown in FIG. 3) and the holding of an umbrella 13 (shown in FIG. 1) in a generally upright position. Clamping closure 17 shown in open position, is hinged to base 14, and contains mating groove 18, aligned so as to mate with groove 15 when closed as illustrated in FIG. 3. FIG. 2 illustrates one embodiment of closure means for hinged clamping closure 17, wherein one element of a hook and loop fasteners such as marketed under the trademark VELCRO, is affixed to closure 17, aligned so as to be mated in closed position with a corresponding hook and loop element 20 affixed to base 14. Void 16 in base 14 accommodates umbrella handles 24 (shown in FIG. 3) having a variety of configurations. Groove 21 mates with certain of said varieties of umbrella handles so as to prevent rotation of the umbrella 13 (shown in FIG. 1) with respect to base 14.

Referring to FIG. 3, a front view of the leg-supported umbrella holder in closed position shows umbrella shaft 23 clamped within hinged clamping enclosure 17, which is hinged by hinges 22 and secured by mating hook and loop fasteners 19, 20 upon base 14. Umbrella handle 24 mates with rotation-inhibiting groove 21 within base 14.

Figure 4:
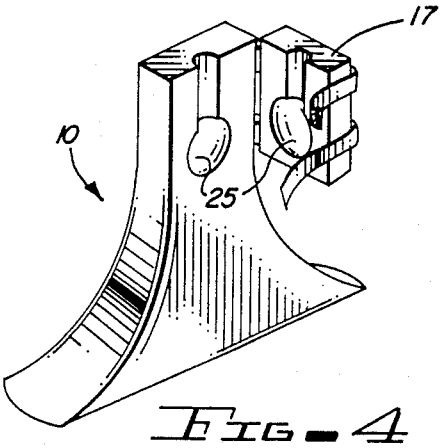
FIG. 4 is a perspective view of a less preferred embodiment of the leg-supported umbrella holder wherein a cutout within clamping means is adapted to an umbrella handle of selected configuration.
Figure 5:
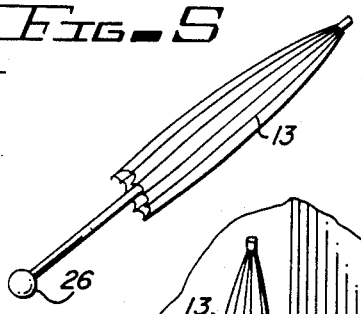
FIG. 5 is a perspective view of a closed umbrella having a selected handle configuration suitable for mating with the cutout of FIG. 4.

Referring to FIGS. 4 and 5, a less-preferred embodiment provides cutouts 25 within the mating portions of base 10 and hinged clamping enclosure 17 to accommodate the specific handle configuration 26 shown in FIG. 5 of umbrella 13.

Figure 6:
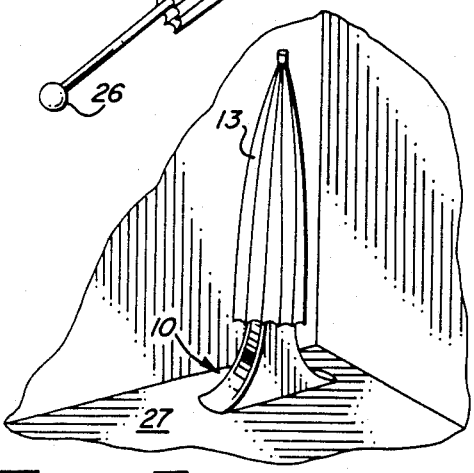
FIG. 6 is a perspective view of the leg-supported umbrella holder employed as a freestanding support for a closed umbrella.

Referring to FIG. 6, a perspective view shows the leg-supported umbrella holder 10 used as a freestanding upright supporter of closed umbrella 13 upon floor or other horizontal surface 27.

What has been disclosed is a leg-supported umbrella holder which is grasped between the thighs of a wheelchair-bound person while supported by the seat of a wheelchair, which holds an umbrella clamped therein in an upright position approximately centered over the wheelchair-bound person, and which permits the person to use both hands for locomotion. Since the holder is not permanently affixed to the wheelchair or to the person, it and the umbrella may be conveniently and rapidly disposed to avoid obstacles and facilitate passage through doorways. Provision is made to accommodate a variety of umbrella handle configurations, or a selected configuration, and for the prevention of rotation of the umbrella with respect to the holder. The holder is suitable for use as a freestanding umbrella stand upon a floor or other horizontal surface providing convenient access to the wheelchair-bound person when the holder is not deployed upon the wheelchair.

While the invention has been particularly shown and described with reference to the preferred embodiments thereof, it will be understood by those skilled in the art that omissions and other changes in form and detail may be made therein without departing from the spirit and scope of the invention. While those skilled in the art will conceive of other embodiments of the invention drawn from the teaching herein, it is intended that such other embodiments, so drawn, shall fall within the ambit of protection of the claims appended hereto.

Having described my invention in the foregoing specification and drawings in such full detail that those skilled in the art may readily understand and practice the invention, that which I claim is:

1. A leg supported umbrella holder comprising:

a base suitable for support upon a generally horizontal surface such as a chair seat, the floor, a tabletop, or the like, and for grasping by the thighs of a person seated in a chair when said base is resting upon a chair seat;

the front and back walls of the base being substantially vertical with a thickness therebetween sufficiently narrow so as to easily slide between a seated persons thighs, and with the sides of the base being substantially concave and tapering from substantially the full width of the base to a narrower upstanding portion so as to be grasped by the thighs of a seated person when turned transverse thereto;

a groove within said upstanding portion for matingly coupling with an umbrella shaft, adjacent its handle end, for holding an umbrella in a generally upright position;

clamping means coupled to said base for maintaining an umbrella shaft matingly coupled to said groove; and a void within said base adjacent said groove for receiving one of umbrella handles of various configurations as may be affixed to an umbrella shaft matingly coupled to said groove.

2. The leg supported umbrella holder of claim 1 further comprising: handle receiving means within said void for receiving and for preventing the rotation of the handle of an umbrella whose shaft is matingly coupled to said groove within said base.

3. The leg supported umbrella holder of claim 1 further comprising: hinge means rotatingly coupling said clamping means to said base.

4. The leg supported umbrella holder of claim 3 further comprising locking means further coupling said base and said clamping means for locking said clamping means to an umbrella shaft which may be mated within said groove in said base.

5. The leg supported umbrella holder of claim 4 wherein said locking means comprise hook and loop fasteners.

6. A leg supported umbrella holder comprising:

a base suitable for support upon a generally horizontal surface such as a chair seat, the floor, a tabletop, or the like, and for grasping by the thighs of a person seated in a chair when said base is resting upon a chair seat;

the front and back walls of the base being substantially vertical with a thickness therebetween sufficiently narrow so as to easily slide between a seated persons thighs, and with the sides of the base each being substantially concave and tapering from substantially the full width of the base to a narrower upstanding portion so as to be grasped by the thighs of a seated person when turned transverse thereto;

a raised portion of said base generally upright when said base is supported upon a generally horizontal surface;

a groove within said raised portion of said base for matingly coupling with an umbrella shaft adjacent its handle end for holding an umbrella in a generally upright position; and clamping means coupled to said base for maintaining an umbrella shaft matingly coupled to said groove.

7. The leg supported umbrella holder of claim 6 further comprising: means for preventing the rotation of an umbrella handle when the shaft of an umbrella is matingly coupled to said groove.

8. The leg supported umbrella holder of claim 6 further comprising: hook and loop fasteners lockingly coupling said clamping means to said base.

9. A freestanding umbrella holder for use by a chair-bound person comprising;

a base;

a base having a flat bottom;

the front and back walls of the base being substantially vertical with a thickness therebetween sufficiently narrow so as to easily slide between a seated persons thighs, and with the sides of the base each being substantially concave and tapering from substantially the full width of the base to a narrower upstanding portion so as to be grasped by the thighs of a seated person when turned transverse thereto; and means for coupling an upstanding umbrella so said base.

* * * * *